US007566054B2

(12) United States Patent
Anelli et al.

(10) Patent No.: US 7,566,054 B2
(45) Date of Patent: Jul. 28, 2009

(54) STACKING DEVICE FOR TISSUES, NAPKINS AND THE LIKE

(75) Inventors: Stefano Anelli, Lucca (IT); Simone Chelossi, Lucca (IT)

(73) Assignee: S-Tech S.R.L., Capannori, Frazione Guamo (IT)

( * ) Notice: Subject to any disclaimer, the term of this patent is extended or adjusted under 35 U.S.C. 154(b) by 11 days.

(21) Appl. No.: 11/730,764

(22) Filed: Apr. 4, 2007

(65) Prior Publication Data

US 2007/0243756 A1 Oct. 18, 2007

(30) Foreign Application Priority Data

Apr. 14, 2006 (IT) ..... BO2006A0289

(51) Int. Cl.
*B65H 29/20* (2006.01)

(52) U.S. Cl. ..... 271/300; 271/315

(58) Field of Classification Search ..... 271/315, 271/69, 187, 300, 213
See application file for complete search history.

(56) References Cited

U.S. PATENT DOCUMENTS 4,357,126 A * 11/1982 Kidd et al. ..... 414/790.3
5,040,783 A * 8/1991 Ruehl ..... 271/300
5,597,285 A * 1/1997 Meyer et al. ..... 414/798.6
6,394,450 B2 * 5/2002 Kishine et al. ..... 271/315
7,318,586 B2 * 1/2008 Leuthold ..... 271/187

FOREIGN PATENT DOCUMENTS

| | | | |
|---|---|---|---|
| DE | 37 00 930 | A1 | 7/1988 |
| DE | 195 44 879 | A1 | 6/1997 |
| EP | 0 344 716 | A | 12/1989 |
| FR | 2 790 251 | A | 9/2000 |

* cited by examiner

*Primary Examiner*—Kaitlin S Joerger
(74) *Attorney, Agent, or Firm*—Modiano & Associati; Albert Josif; Daniel J. O'Byrne

(57) ABSTRACT

A stacking device for sheet products, comprising at least one wheel associated with rotary actuation means that has at least one plurality of tangential peripheral receptacles for accommodating already-folded products fed by a conveyor to at least one pick-up station, at least one first product deposition station, provided with a first fixed stop element for engaging the products accommodated in the receptacles and with a first movable supporting surface for picking up a first stack of products extracted from the receptacles, and at least one second product deposition station, which is provided with a second upper stop element and a second lower stop element, movable in opposition and both suitable to engage products accommodated in the receptacles, and with a second movable supporting surface suitable to pick up a second stack of products extracted from the receptacles.

16 Claims, 3 Drawing Sheets

STACKING DEVICE FOR TISSUES, NAPKINS AND THE LIKE

The present invention relates to a stacking device for sheet products, such as tissues, napkins and the like.

BACKGROUND OF THE INVENTION

Lines for the production of paper products such as tissues and napkins of various sizes typically have a stacking step in which the products, already folded up according to one of the possible configurations, must be picked up, as they arrive from the folding station, by conveyor means, for example belts or the like, and positioned precisely on each other to be then packaged in packs of a preset number of items.

This stacking operation is usually performed by using one or more star conveyors provided with peripheral receptacles in which the products which arrive from the conveyor means are inserted and by which they are then deposited one by one on a movable supporting surface which forms the stack which will then be packaged into a packet. The need to unload the stack from the supporting surface to make it reach the packaging station requires the star conveyor to remain periodically inactive for a given period of time.

Since transfer star conveyors cannot turn faster than a given limit which is set during design, in order to increase the production rate some packaging lines therefore use even more than one star conveyor: for example two star conveyors are used which are powered by the same conveyance means and work alternately with each other.

This last solution and other similar ones, however, are rather complicated in terms of design and manufacture and are usually adopted in large high-productivity lines which have very high installation and maintenance costs.

SUMMARY OF THE INVENTION

The aim of the present invention is to obviate the above-cited drawbacks, by providing a stacking device for tissues, napkins and the like which allows to increase the production rate of stacks of products by using a single transfer star conveyor.

Within this aim, an object of the present invention is to provide a stacking device which is simple, relatively easy to provide in practice, safe in use, effective in operation and has a relatively low cost.

This aim and this and other objects that will become better apparent hereinafter are achieved by the present stacking device for sheet products such as tissues, napkins and the like, characterized in that it comprises at least one wheel, which is associated with rotary actuation means and is affected peripherally by at least one plurality of substantially tangential receptacles which are suitable to accommodate already-folded products which arrive from conveyor means at least one pick-up station, at least one first product deposition station, which is provided with a first fixed stop element which is suitable to engage the products accommodated in said receptacles and with a first movable supporting surface which is suitable to pick up a first stack of products extracted from said receptacles, and at least one second product deposition station, which is provided with a second upper stop element and a second lower stop element, which can move in opposition and are both suitable to engage the products in said receptacles, and with a second movable supporting surface, which is suitable to pick up a second stack of products extracted from said receptacles.

BRIEF DESCRIPTION OF THE DRAWINGS

Further characteristics and advantages of the invention will become better apparent from the following detailed description of a preferred but not exclusive embodiment of a stacking device for tissues, napkins and the like according to the invention, illustrated by way of nonlimiting example in the accompanying drawings, wherein.

DESCRIPTION OF THE PREFERRED EMBODIMENTS

In the exemplary embodiment that follows, individual characteristics may actually be interchanged with other different characteristics that exist in other exemplary embodiments.

Moreover, it is noted that anything found to be already known during the patenting process is understood not to be claimed and to be the subject of a disclaimer.

Figure 1:
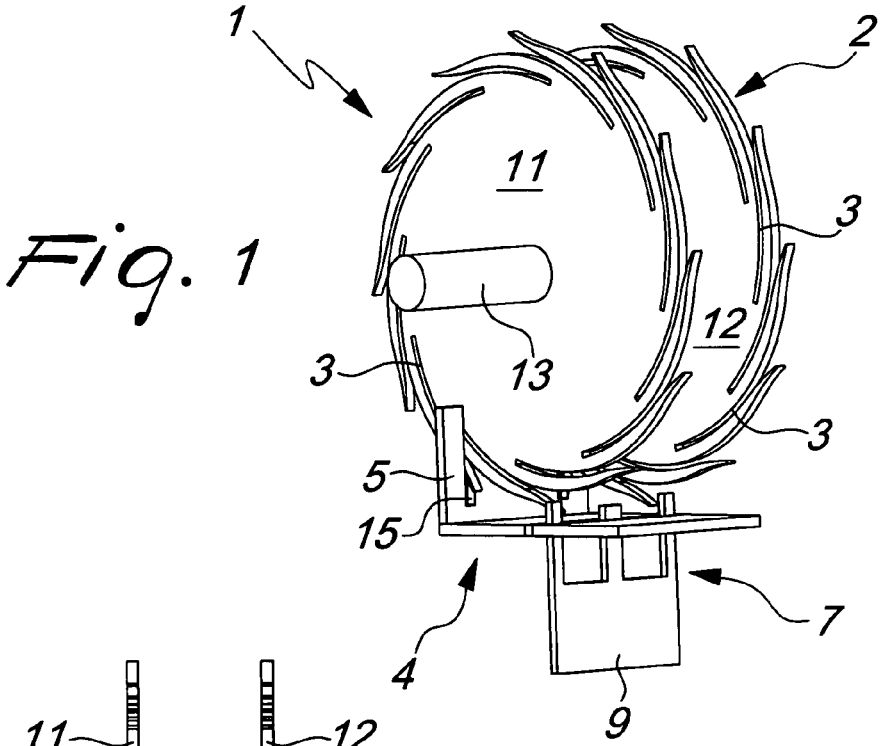
FIG. 1 is a perspective view of the stacking device according to the invention.

With reference to FIG. 1, the reference numeral 1 generally designates a stacking device for sheet products, such as tissues, napkins and the like according to the invention.

The stacking device described hereinafter is conceived to be extremely flexible and versatile in use, i.e., it is adapted to provide stacks of products of any size and shape; the device is particularly but not exclusively intended to mutually stack tissues and napkins of the paper-like type.

The stacking device 1 comprises at least one wheel, generally designated by the reference numeral 2, which is associated with rotary actuation means, which are of a substantially traditional type. The wheel 2 is affected peripherally by a plurality of receptacles 3, which are arranged substantially tangentially, are mutually angularly equidistant and are adapted to accommodate the already-folded products which arrive from conveyor means at least one pick-up station, said means not being shown in the figures but being constituted for example by belts or the like.

The device according to the invention advantageously comprises a first product deposition station, generally designated by the reference numeral 4, which is provided with a first fixed stop element 5, which is suitable to affect the products accommodated in the receptacles 3, and a first movable supporting surface 6, which is suitable to pick up a first stack of products extracted one by one from the receptacles 3 by way of the contrast offered by the first stop element.

The device further comprises advantageously a second product deposition station, generally designated by the reference numeral 7, which is provided with a second upper movable stop element 8 and a second lower movable stop element 9, both of which are adapted to engage the products accommodated in the receptacles 3, and a second movable supporting surface 10, which is adapted to pick up a second stack of products extracted one by one from the receptacles 3.

In greater detail (FIG. 1), the wheel 2 comprises a first disk 11 and a second disk 12, which are flat and located mutually parallel and opposite, have identical dimensions and are keyed rigidly, at a preset distance from each other, along a shaft 13, which is part of the rotary actuation means. The first and second disks 11, 12 are functionally connected and controlled by the control unit of the production line.

The first disk 11 and the second disk 12 are affected (provided with), as mentioned earlier, by the respective pluralities of receptacles 3; of course, the first disk 11 and the second disk 12 must be arranged angularly with respect to each other precisely, so that the respective receptacles 3 match up so that the products can be inserted therein with the correct orientation. Each of the receptacles 3 is conveniently provided with a substantially involute profile, with an initial inlet portion 14 which has a larger cross-section in order to facilitate the insertion of the products that arrive from the conveyor means.

Figure 3:
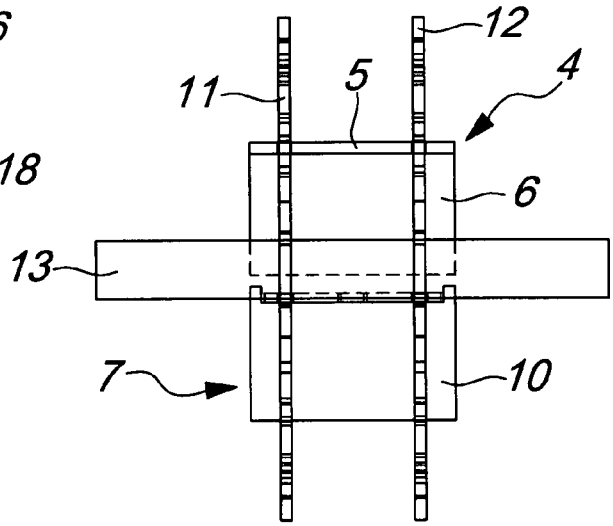
FIG. 3 is a top view of the device according to the invention.

The first stop element 5 is rigidly coupled to fixed parts of the device, which are not shown for the sake of simplicity in the figures, and is shaped substantially like a plate with two slots 15 which allow the free rotation, through said slots, of the first disk 11 and of the second disk 12 of the wheel 2 (FIGS. 1, 3).

Figure 5:
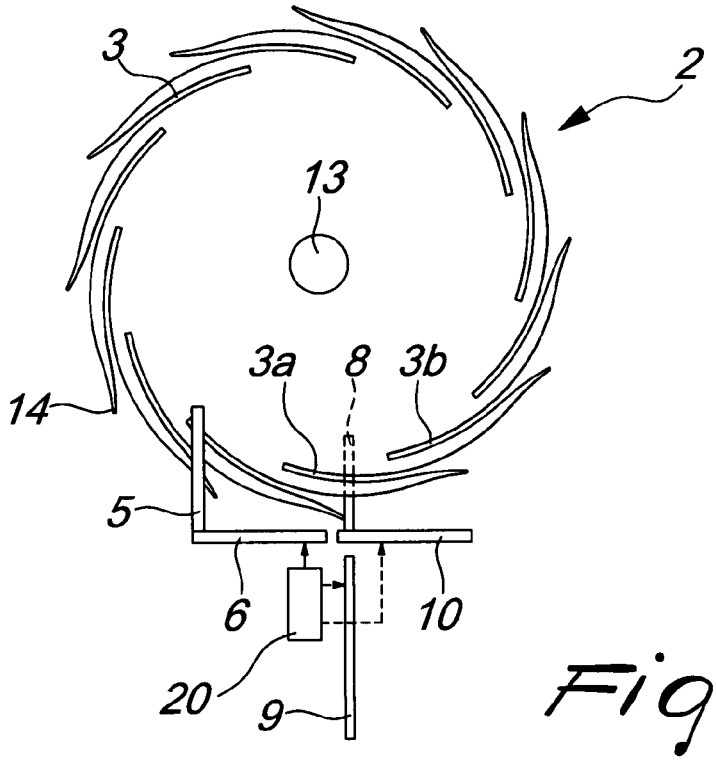
FIG. 5 is a side elevation view of the device in a second step of operation.

The first supporting surface 6, which is substantially plate-shaped, is associated with respective means 20 for vertical translational motion, which are indicated schematically in FIG. 5 being of a conventional type (for example of the electric or pneumatic type) and are connected functionally to the means for the rotary actuation of the wheel 2: the first supporting surface 6 can move selectively, and in relation to the operating steps, between at least one upper stroke limit position, in which it does not support products, to at least one lower stroke limit position, in which it supports the first stack of picked-up products, by contrast performed by the first stop element 5, from the receptacles 3 of the wheel 2.

Figure 2:
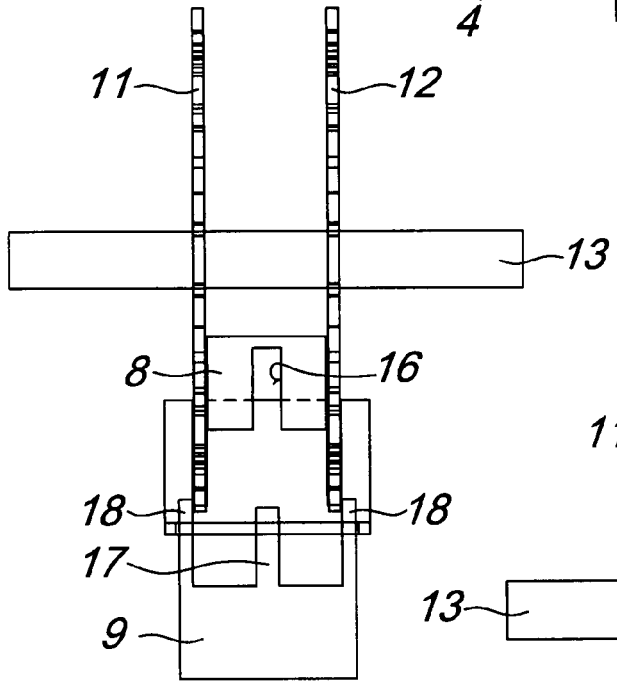
FIG. 2 is a front view of said device.

The second movable upper stop element 8 is substantially plate-shaped (FIG. 2) and is affected by at least one central slot 16 and is interposed between the first disk 11 and the second disk 12.

The second movable lower stop element 9 is substantially plate-shaped and has a central extension 17, which is adapted to enter the central slot 16 of the second upper stop element 8 (as will become better apparent hereinafter), and two lateral extensions 18 which are equidistant with respect to the central slot 16.

Figure 6:
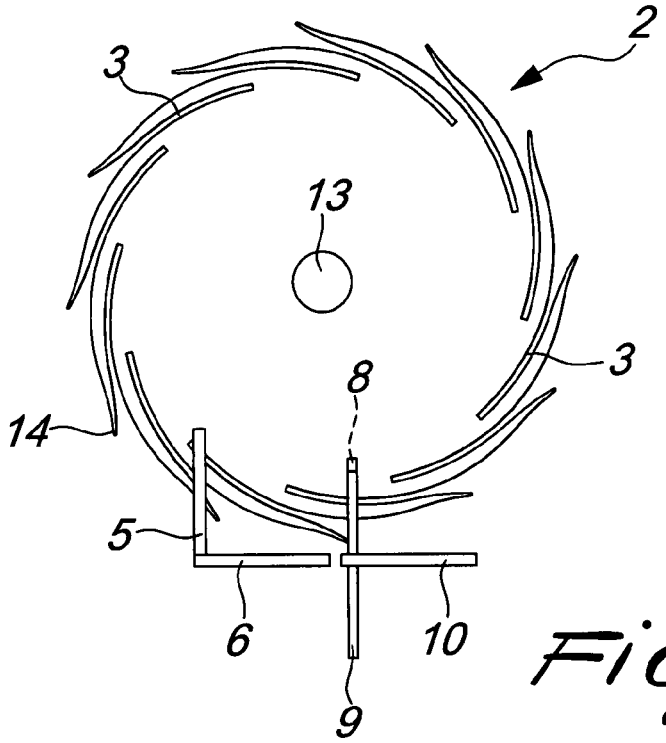
FIG. 6 is a side elevation view of the device in a third step of operation.
Figure 7:
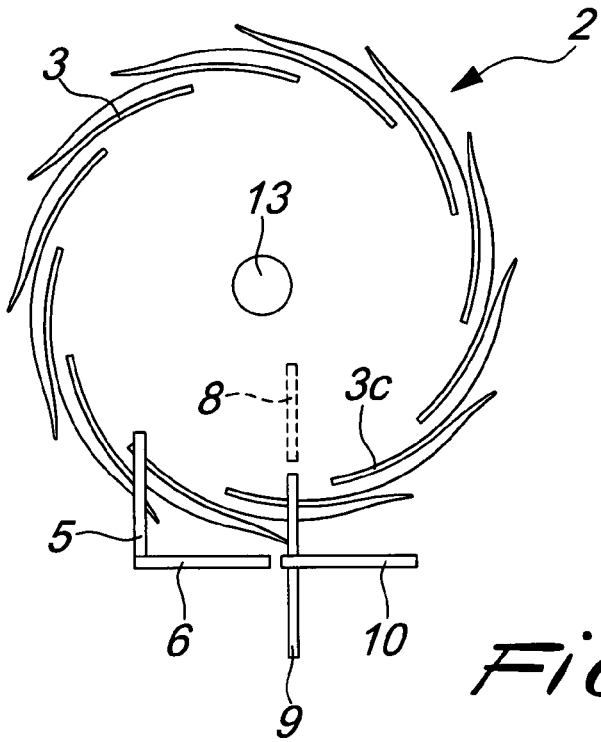
FIG. 7 is a side elevation view of the device in a fourth step of operation.

The second upper stop element 8 is associated advantageously with respective translational motion means, which are not shown in the figures but are of a traditional type (for example of the electric or pneumatic type) and are functionally connected to the means for the rotary actuation of the wheel 2: the second upper stop element 8 can move selectively, in relation to the various steps of operation, between at least one inactive upper stroke limit position (FIGS. 4 and 7) and at least one lower stroke limit position (FIGS. 5 and 6), in which it interferes with the rotational path of the receptacles 3, allowing to extract the products and collect them on the second supporting surface 10.

The second lower stop element 9 is associated with respective translational motion means, which are not shown in the figures but are of a traditional type (for example of the electric or pneumatic type), are functionally connected to the means for the rotary actuation of the wheel 2, and can move selectively between at least one inactive lower stroke limit position (FIGS. 4, 5) and at least one upper stroke limit position (FIGS. 6, 7), in which it interferes with the rotational path of the receptacles 3, allowing to extract the products and collect them on the second supporting surface 10; in this upper stroke limit position, the second lower stop element 9 has its central extension engaged in the central slot 16 of the second upper stop element 8, in its lower stroke limit position.

The second supporting surface 10 is associated with respective translational motion means, which are not shown in the figures but are of a traditional type (for example of the electric or pneumatic type), which are functionally connected to the means for rotary actuation of the wheel 2, and can move selectively between at least one upper stroke limit position without products and at least one lower stroke limit position, in which it supports the second stack of products collected from the receptacles 3 of the wheel 2.

The operation of the stacking device according to the invention is as follows.

Figure 4:
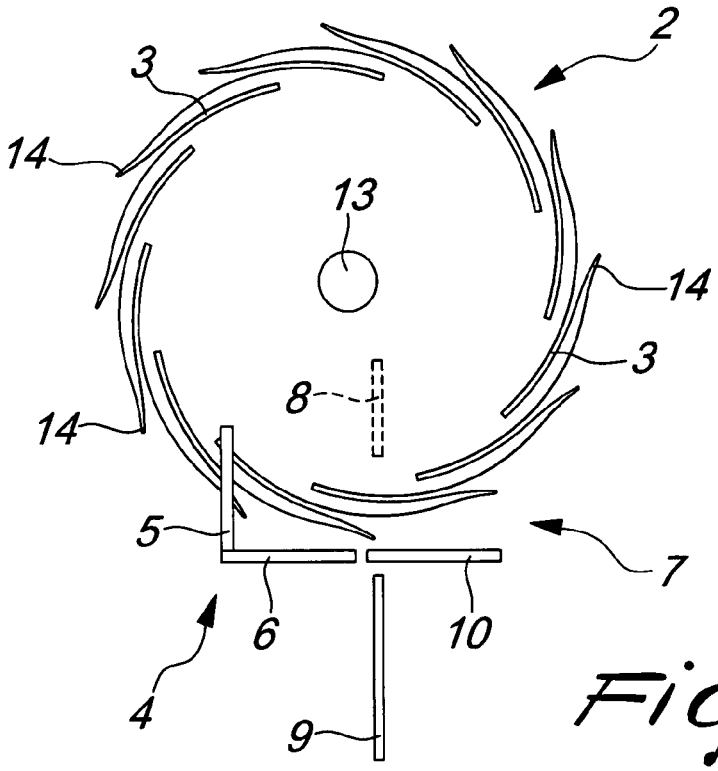
FIG. 4 is a side elevation view of the device in a first step of operation.

With reference to FIG. 4, in a first step the first supporting surface 6 is in the upper stroke limit position; the second upper stop element 8 is also in the upper stroke limit position, while the second lower stop element 9 is in the lower stroke limit position. The products, picked up from the conveyor means and inserted in the receptacles 3, are extracted from them by interference with the first stop element 5, and are deposited one on top of the other on the first supporting surface 6, thus forming the first stack of products: the first supporting surface 6 therefore descends gradually to the lower stroke limit position.

When the number of products collected in the first stack (on the first supporting surface 6) is the one intended for packaging, i.e., the last product is collected up from the receptacle designated by the reference numeral 3*a* in FIG. 5, the second upper stop element 8 is made to descend from the inactive upper stroke limit position to a substantially intermediate position, and this occurs before the arrival of the next receptacle, designated by the reference numeral 3*b*, which bears the product which is to be the first to form the second stack. In this intermediate position, the second upper stop element allows to lock the product inserted in the receptacle 3*b* but does not interfere with the passage of the product inserted in the receptacle 3*a* intended for the first stack. Subsequently, the first upper stop element 8 descends to its lower stroke limit position 6. This step of operation lasts until the second stack of products also is completed by way of the descent of the second supporting surface 10; in a subsequent step (FIG. 6), the second lower stop element 9 is moved from the inactive lower stroke limit position to the upper stroke limit position, in which it couples in a comb-like fashion with the second upper stop element 8.

In the subsequent step (FIG. 7), the second upper stop element 8 rises from the lower stroke limit position to the upper stroke limit position and therefore in practice the second lower stop element 9 replaces the first upper stop element 8, so as to engage and extract, from the receptacle 3*c*, the last product intended for the second stack. Once the last product has been extracted, the second lower stop element 9 descends again toward the lower stroke limit position; in the meantime, the first supporting surface 6 rises to the upper stroke limit position, so as to resume the cycle for forming the first stack of products as described above.

It has thus been shown that the invention achieves the intended aim and objects.

The stacking device according to the invention allows to obtain the formation of two stacks of products from a single transfer star conveyor, accordingly increasing substantially the production rate without having to resort to expensive constructive complications.

The term "substantially", as herein used, is intended to mean that the features to which it refers have the only characteristics indicated but for shape and dimension tolerances that are well known to those skilled in the art.

The invention thus conceived is susceptible of numerous modifications and variations, all of which are within the scope of the appended claims.

All the details may further be replaced with other technically equivalent ones.

In practice, the materials used, as well as the contingent shapes and dimensions, may be any according to requirements without thereby abandoning the scope of the protection of the appended claims.

The disclosures in Italian Patent Application No. BO2006A000289 from which this application claims priority are incorporated herein by reference.

What is claimed is:

1. A stacking device for sheet products, comprising at least one wheel; rotary actuation means connected to said wheel for actuation thereof; at least one plurality of substantially tangential receptacles provided in a peripheral region of said wheel and which are suitable to accommodate already-folded sheet products which are fed from conveyor means at at least one pick-up station; at least one first product deposition station, which is provided with a first fixed stop element which is suitable to engage the products accommodated in said receptacles and with a first movable supporting surface which is suitable to pick up a first stack of sheet products extracted from said receptacles; and at least one second product deposition station, which is provided with a second upper stop element and a second lower stop element, which are movable in opposition and are both suitable to engage the sheet products accommodated in said receptacles, and with a second movable supporting surface, which is suitable to pick up a second stack of sheet products extracted from said receptacles, wherein said wheel comprises a first disk and a second disk which are flat and mutually parallel and opposite and wherein said rotary actuation means comprise at least one shaft, said first and second disks being keyed rigidly along said at least one shaft, and being provided with respective pluralities of peripheral receptacles, said second upper movable stop element being substantially plate-shaped, being provided with at least one central slot and being arranged between said first disk and said second disk.

2. The stacking device of claim 1, wherein each of said receptacles is provided with a substantially involute profile, with an inlet portion which has a larger cross-section in order to facilitate insertion of the products fed by conveyor means.

3. The stacking device of claim 1, wherein said first stop element is rigidly coupled to fixed parts of the device, is substantially plate-shaped and is provided with a pair of slots which are suitable to allow rotation of said first and second disks of said wheel.

4. The stacking device of claim 1, comprising translational motion means connected to said first supporting surface and which are functionally connected to said rotary actuation means, said first supporting surface being movable selectively between at least one upper stroke limit position without sheet products supported thereon to at least one lower stroke limit position, in which the first supporting surface supports said first stack of sheet products picked up from said receptacles of said wheel.

5. The stacking device of claim 1, wherein said second movable lower stop element is substantially plate-shaped and has at least one central protrusion which is suitable to enter said central slot of said second upper stop element.

6. The stacking device of claim 5, wherein said second upper stop element is connected with respective translational motion means, which are functionally connected to said rotary actuation means and is movable selectively between at least one inactive upper stroke limit position and at least one lower stroke limit position, in which the second upper stop element interferes with a rotational path of said receptacles, whereby to allow extraction of the sheet products and collection thereof on said second supporting surface.

7. The stacking device of claim 6, wherein said second lower stop element is connected with said respective translational motion means, which are functionally connected to said rotary actuation means, and is selectively movable between at least one inactive lower stroke limit position and at least one upper stroke limit position, in which the second lower stop element interferes with a rotational path of said receptacles, allowing extraction of the sheet products and their collection on said second supporting surface.

8. The stacking device of claim 7, wherein said second supporting surface is connected to said respective translational motion means, which are functionally connected to said rotary actuation means and is movable selectively between at least one upper stoke limit position without sheet products supported thereon and at least one lower stroke limit position, in which the second supporting surface supports said second stack of products picked up from said receptacles of said wheel.

9. A stacking device for sheet products, comprising:

at least one wheel;

rotary actuation means connected to said wheel for actuation thereof;

at least one plurality of substantially tangential receptacles provided in a peripheral region of said wheel and which are suitable to accommodate already-folded sheet products which are fed from conveyor means at at least one pick-up station;

at least one first product deposition station, which is provided with a first fixed stop element which is suitable to engage the products accommodated in said receptacles and with a first movable supporting surface which is suitable to pick up a first stack of sheet products extracted from said receptacles; and at least one second product deposition station, which is provided with a second upper stop element and a second lower stop element, which are movable in opposition and are both suitable to engage the sheet products accommodated in said receptacles, and with a second movable supporting surface, which is suitable to pick up a second stack of sheet products extracted from said receptacles, wherein said wheel comprises a first disk and a second disk, which are flat and mutually parallel and opposite, said rotary actuation means comprising at least one shaft, said first and second disks being keyed rigidly along said at least one shaft, and being provided with respective pluralities of peripheral receptacles, and wherein said second movable lower stop element is substantially plate-shaped and has at least one central protrusion which is suitable to enter said central slot of said second upper stop element.

10. A stacking device for sheet products, comprising:

at least one wheel;

rotary actuation means connected to said wheel for actuation thereof;

at least one plurality of substantially tangential receptacles provided in a peripheral region of said wheel and which are suitable to accommodate already-folded sheet products which are fed from conveyor means at at least one pick-up station;

at least one first product deposition station, which is provided with a first fixed stop element which is suitable to engage the products accommodated in said receptacles and with a first movable supporting surface which is suitable to pick up a first stack of sheet products extracted from said receptacles;

at least one second product deposition station, which is provided with a second upper stop element and a second lower stop element, which are movable in opposition and are both suitable to engage the sheet products accommodated in said receptacles, and with a second movable supporting surface, which is suitable to pick up a second stack of sheet products extracted from said receptacles; and translational motion means connected to said first supporting surface and which are functionally connected to said rotary actuation means, said first supporting surface being movable selectively between at least one upper stroke limit position without sheet products supported thereon to at least one lower stroke limit position, in which the first supporting surface supports said first stack of sheet products picked up from said receptacles of said wheel.

11. The stacking device of claim 10, wherein said wheel comprises a first disk and a second disk, which are flat and mutually parallel and opposite and wherein said rotary actuation means comprise at least one shaft, said first and second disks being keyed rigidly along said at least one shaft, and being provided with respective pluralities of peripheral receptacles.

12. The stacking device of claim 11, wherein said second upper movable stop element is substantially plate-shaped, is provided with at least one central slot and is arranged between said first disk and said second disk.

13. The stacking device of claim 12, wherein said second movable lower stop element is substantially plate-shaped and has at least one central protrusion which is suitable to enter said central slot of said second upper stop element.

14. The stacking device of claim 13, wherein said second upper stop element is connected with respective translational motion means, which are functionally connected to said rotary actuation means and is movable selectively between at least one inactive upper stroke limit position and at least one lower stroke limit position, in which the second upper stop element interferes with a rotational path of said receptacles, whereby to allow extraction of the sheet products and collection thereof on said second supporting surface.

15. The stacking device of claim 14, wherein said second lower stop element is connected with said respective translational motion means, which are functionally connected to said rotary actuation means, and is selectively movable between at least one inactive lower stroke limit position and at least one upper stroke limit position, in which the second lower stop element interferes with a rotational path of said receptacles, allowing extraction of the sheet products and their collection on said second supporting surface.

16. The stacking device of claim 15, wherein said second supporting surface is connected to said respective translational motion means, which are functionally connected to said rotary actuation means and is movable selectively between at least one upper stroke limit position without sheet products supported thereon and at least one lower stroke limit position, in which the second supporting surface supports said second stack of products picked up front said receptacles of said wheel.

* * * * *